US008616906B2

(12) United States Patent
Iijima et al.

(10) Patent No.: US 8,616,906 B2
(45) Date of Patent: Dec. 31, 2013

(54) FLEXIBLE PRINTED CIRCUIT CONNECTOR

(75) Inventors: Hideki Iijima, Machida (JP); Naoya Matsuura, Yokohama (JP)

(73) Assignee: Molex Incorporated, Lisle, IL (US)

( * ) Notice: Subject to any disclaimer, the term of this patent is extended or adjusted under 35 U.S.C. 154(b) by 248 days.

(21) Appl. No.: 13/037,902

(22) Filed: Mar. 1, 2011

(65) Prior Publication Data

US 2011/0275238 A1 Nov. 10, 2011

(30) Foreign Application Priority Data

Mar. 1, 2010 (JP) ..... 2010-044219

(51) Int. Cl.
*H01R 13/15* (2006.01)

(52) U.S. Cl.
USPC ..... 439/260; 439/329; 439/495

(58) Field of Classification Search
USPC ..... 439/266, 260, 329, 495
See application file for complete search history.

(56) References Cited

U.S. PATENT DOCUMENTS

| | | | | |
|---|---|---|---|---|
| 7,083,455 | B1 * | 8/2006 | Miura et al. | 439/260 |
| 7,094,093 | B2 | 8/2006 | Nakano et al. | |
| 7,134,891 | B2 | 11/2006 | Kayama et al. | |
| 7,661,972 | B2 * | 2/2010 | Okamura et al. | 439/260 |
| 7,909,639 | B2 | 3/2011 | Hirata et al. | |
| 8,272,889 | B2 * | 9/2012 | Matoba et al. | 439/495 |
| 2007/0254534 | A1 * | 11/2007 | Okamura et al. | 439/783 |
| 2009/0137141 | A1 * | 5/2009 | Hashimoto et al. | 439/266 |
| 2011/0136365 | A1 * | 6/2011 | Hara | 439/329 |
| 2012/0231637 | A1 * | 9/2012 | Takeuchi et al. | 439/65 |

FOREIGN PATENT DOCUMENTS

JP 2003-167492 6/2005

* cited by examiner

*Primary Examiner* — Truc Nguyen
(74) *Attorney, Agent, or Firm* — Timothy M. Morella

(57) ABSTRACT

An engaged protrusion is formed in a flat cable connected to a connector. The housing of the connector has an engaging protrusion rising in front of the position in which the engaged protruding portion is arranged when the flat cable is connected. A reinforced metal fitting has a reinforced protrusion raised along the engaging protrusion. The rear surface of the engaging protrusion is positioned to the rear of the rear surface of the reinforced protrusion. The rear surface of the reinforced protrusion is formed so as to extend upward and forward.

10 Claims, 7 Drawing Sheets

FLEXIBLE PRINTED CIRCUIT CONNECTOR

REFERENCE TO RELATED APPLICATIONS

The Present Disclosure claims priority to prior-filed Japanese Patent Application No. 2010-44219, entitled "A Connector And A Cable Assembly Having A Flat Cable, And A Connector To Which The Flat Cable Is Connected," filed on 1 Mar. 2010 with the Japanese Patent Office. The content of the aforementioned patent application is fully incorporated in its entirety herein.

BACKGROUND OF THE PRESENT DISCLOSURE

The Present Disclosure relates, generally, to a connector and a cable assembly having the ability of preventing a flat cable from falling out of the assembly and, more specifically, to technology for preventing damage to a flat cable when the flat cable is pulled out strongly.

Conventionally, connectors may be used to connect flat cables such as Flexible Printed Circuits (FPC) and Flexible Flat Cables (FFC). Such connectors generally include a plurality of terminals lined up longitudinally and a molded housing for housing the terminals.

The connector disclosed in U.S. Pat. No. 4,215,265, for example, has a reinforced molded metal fitting on each side of the terminals. Because the fittings in this connector are soldered to a circuit board in addition to the terminals, the mounting strength to the circuit board is increased. Further, a protrusion is formed on a longitudinal edge of the flat cable, and engages the connector. More specifically, a recessed portion is formed in the upper edge of the fitting, and the protrusion is arranged inside this recessed portion when the flat cable is connected to the connector. When a force acts to pull the flat cable out of the connector, the protrusion on the flat cable is caught by the metal fitting, and is prevented from coming out.

However, in the '265 Patent, the fittings are formed from metal, and the flat cable is molded with resin. As a result, the protrusion of the flat cable can easily be deformed when the flat cable is extricated. For this reason, a structure has been considered in which the flat cable is kept from coming out by a resin-molded housing, instead of a reinforced metal fitting. However, even in this structure, the portion of the housing hitting the protrusion of the flat cable can still be deformed when the flat cable is pulled out.

SUMMARY OF THE PRESENT DISCLOSURE

An object of the Present Disclosure is, therefore, to provide a connector able to keep a flat cable from coming out of the connector and able to reduce deformation of the housing and flat cable, and to provide a cable assembly including a connector and a flat cable.

In order to solve the above-stated disadvantages, the Present Disclosure focuses on a connector in which a flat cable, on which an engaged protrusion has been formed extending outward longitudinally on at least one longitudinal edge, can be inserted from the front. This connector preferably comprises a plurality of terminals lined up longitudinally, a reinforced metal fitting positioned to the outside of the plurality of terminals to the left and right and a resin-molded housing for holding the terminals and the fitting. The housing has an engaging protrusion rising in front of the position, which is arranged when the flat cable is connected. The fitting has a reinforced protrusion raised along the engaging protrusion and positioned to the outside of the engaging protrusion longitudinally. The rear surface of the engaging protrusion is positioned to the rear of the rear surface of the reinforced protrusion. The rear surface of the reinforced protrusion is formed so as to extend upward and forward.

Further, the Present Disclosure focuses on a cable assembly comprising a flat cable, on which an engaged protrusion is formed extending outward longitudinally on at least one longitudinal edge, and a connector to which the flat cable is connected. The connector comprises a plurality of terminals lined up longitudinally, a reinforced metal fitting positioned to the outside of the terminals to the left and right, and a resin-molded housing for holding the terminals and the reinforced metal fitting. The housing has an engaging protrusion rising in front of the position in which the engaged protruding portion, which is arranged when the flat cable is connected. The fitting has a reinforced protrusion raised along the engaging protrusion and positioned to the outside of the engaging protrusion longitudinally. The rear surface of the engaging protrusion is positioned to the rear of the rear surface of the reinforced protrusion. The rear surface of the reinforced protrusion is formed so as to extend upward and forward.

In the Present Disclosure, the rear surface of the engaging protrusion is positioned to the rear of the rear surface of the reinforced protrusion when the direction of insertion of the flat cable is to the rear. As a result, the engaged protrusion of the flat cable hits the engaging protrusion when the flat cable is pulled out towards the front, and the flat cable is kept from coming out. The housing is also resin-molded, reducing deformation of the engaged protrusion of the flat cable better than situations in which a flat cable is kept from coming out using reinforced metal fittings. A reinforced protrusion is raised along the engaging protrusion, which limits deformation of the engaging protrusion. Because the rear surface of the reinforced protrusion is formed so as to extend upward and forward, the strength of the reinforced protrusion is ensured, and the engaged protrusion is reliably prevented from hitting the reinforced protrusion.

In an aspect of the connector of the Present Disclosure, a gap can be formed between the reinforced protrusion and the engaging protrusion. In this aspect, the engaged protrusion of the flat cable is allowed to move slightly relative to the engaging protrusion when it hits the engaging protrusion on the housing. As a result, deformation by the engaged protrusion of the flat cable is effectively prevented.

In another aspect of the connector of the Present Disclosure, the housing can have a lower wall portion positioned below the engaged protrusion when the flat cable is connected. Also, the contacts of the plurality of terminals establishing contact with the flat cable can be positioned to the left or to the right of the lower wall portion, and positioned above the upper surface of the lower wall portion of the housing. In this aspect, the flat cable is supported at a position higher than the terminal contacts. As a result, the engaged protrusion of the flat cable easily goes over the engaging protrusion of the housing when the flat cable is pulled out.

In an aspect of the cable assembly of the Present Disclosure, the front edge hitting the engaging protrusion when the flat cable is moved forward is formed on the edge of the engaged protrusion of the flat cable, and the direction in which the front edge hits the engaging protrusion extends outward longitudinally. As such, when the flat cable is pulled forward, a force separates the engaging protrusion outward longitudinally relative to the engaging protrusion. Because the reinforced protrusion is positioned to the outside of the engaging protrusion, movement of the engaging protrusion caused by a force sustained from the flat cable can be prevented.

In another aspect of the cable assembly, a recessed portion having an arc-shaped edge can be formed on at least one edge of the flat cable. The front edge of the engaged protrusion formed in the flat cable can also extend from the edge of the recessed portion. When the front edge of the engaged protrusion hits the engaged protrusion, the stress generated in the engaged protrusion is distributed along the edge of the recessed portion, keeping the engaged protrusion from breaking.

In another aspect of the cable assembly, a gap can be formed between the reinforced protrusion and the engaging protrusion. In this aspect, the engaged protrusion of the flat cable is allowed to move slightly relative to the engaging protrusion when it hits the engaging protrusion on the housing. As a result, deformation by the engaged protrusion is effectively prevented.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
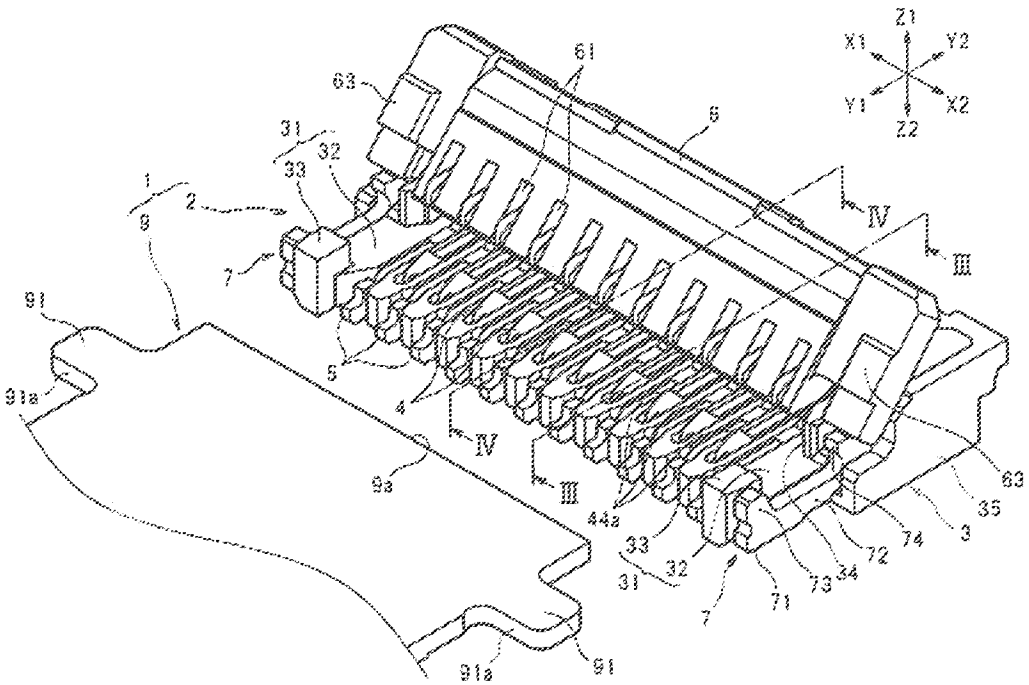
FIG. 1 is a perspective view of a connector and a flat cable in a cable assembly according to an embodiment of the Present Disclosure.
Figure 2:
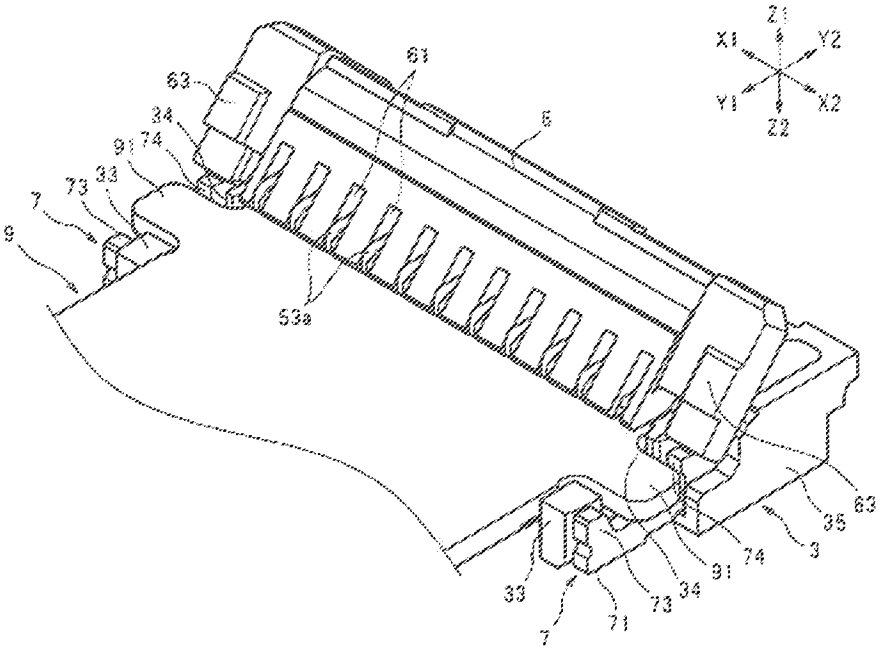
FIG. 2 is a perspective view of the cable assembly of FIG. 1, where the flat cable has been inserted into the connector.

As shown in FIG. 1, the cable assembly 1 has a flat cable 9 and a connector 9 into which the flat cable 9 can be inserted from the front. The flat cable 9 has flexibility, and can be a FPC or a FFC. The flat cable 9 has a base film molded with a resin such as a polyimide, and a plurality of conductive circuit paths in the base film. Flat, plate-like engaged protrusions 91 extending outward longitudinally (in the direction indicated by X1-X2) are formed on the left and right edges of the flat cable 9. An engaged protrusion 91 is positioned both to the left and right of the front end of the flat cable 9. The front end of the flat cable 9 is inserted into the connector 2 (see FIG. 2). In this example, the engaged protrusions 91 are positioned slightly in front of the edge 9*a* of the flat cable 9 lengthwise, and can be formed on both ends of the edge 9*a*.

As shown in FIG. 1, the connector 2 has a plurality of terminals 4, 5 lined up to the left and right, and a housing 3 for holding the terminals 4, 5, and into which the front end of the flat cable 9 can be inserted. In this example, the connector has two types of connection terminals—rear connection terminals 4 and front connection terminals 5. The rear connection terminals 4 and the front connection terminals 5 are lined up in alternating fashion.

Figure 3:
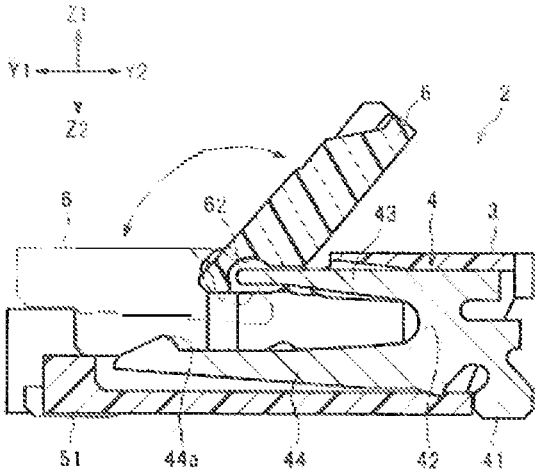
FIG. 3 is a cross-sectional view of the connector of FIG. 1, from Line III-III of FIG. 1, showing the rear connection terminals in the connector.

As shown in FIG. 3, the rear connection terminals 4 have a connection portion 41 on the rearmost portion, soldered to the circuit board (not shown) and mounted on the connector 2 during use. The rear connection terminals 4 have an upper beam 43 and a lower beam 44 extending forward from the base portion 42 (in the direction indicated by Y1). The front end of the flat cable 9 is inserted from the front between the upper beam 43 and the lower beam 44. In this example, a conductive path (not shown) is formed on the bottom surface of the flat cable 9, and a contact portion 44*a* is formed at the tip of the lower beam 44 to establish contact with the conductive path on the flat cable 9. The rear connection terminals 4 are forcibly pushed into the housing 3 from the rear.

Figure 4:
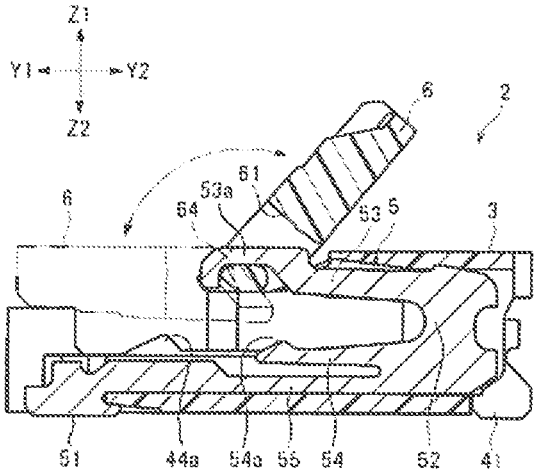
FIG. 4 is a cross-sectional view of the connector of FIG. 1, from Line IV-IV of FIG. 1, showing the front connection terminals in the connector.

As shown in FIG. 4, the front connection terminals 5 have a connection portion 51 on the foremost portion, soldered to the printed circuit board of the connector 2 during use. The front connection terminals 5 have an upper beam 53 and a lower beam 54 extending forward from the base portion 52 positioned in the rearmost portion of the front connection terminals 5. The front end of the flat cable 9 is inserted from the front between the upper beam 53 and the lower beam 54. In this example, as in the rear connection terminal 4, a contact portion 54*a* is formed at the tip of the lower beam 54. An electrical connection is established between a front connection terminal 5 and the flat cable 9 when the contact portion 54*a* comes into contact with a conductive path on the flat cable 9. The front connection terminals 52 also have a bottom extending portion 55 extending forward from the base portion 53 below the lower beam 54. A connection portion 51 is formed in the foremost portion of the bottom extending portion 55. The front connection terminals 5 are forcibly pushed into the housing 3 from the front. The contact portions 44*a* on the rear connection terminals 4 described above are positioned in front of the contact portions 54*a* on the front connection terminals 5 (see FIG. 4).

As shown in FIG. 1, the connector 2 has an actuator 6 for locking the flat cable 9 in the front portion. As shown in FIGS. 3-4, a hole 61 for inserting the upper beams 53 of the front connection terminals 5 and a recessed portion 62 for inserting the upper beams 43 of the rear connection terminals 4 are formed in the actuator 6. A cam portion 64 is formed in the hole 61, positioned below the tip of the upper beam 53 and engaged by a hook portion 53*a* formed at the tip. The actuator 6 is able to turn forward and rearward around the cam portion 64. In other words, the actuator 6 turns around the cam portion 64 between the locked position (where the actuator 6 is positioned, indicated by the dotted lines in FIGS. 3-4) and the unlocked position (where the actuator 6 is positioned, indicated by the solid lines in FIGS. 3-4). In the locked position, the actuator 6 is positioned above the inserted flat cable 6, which pushes the flat cable 9 against the lower beams 44, 54. In the unlocked position, the actuator 6 stands erect above the upper beams 43, 53. As a result, the flat cable 9 can be inserted into the connector 2.

Figure 5:
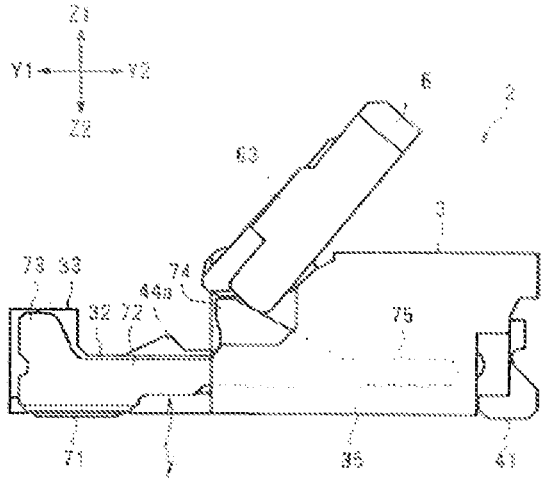
FIG. 5 is a side view of the connector of FIG. 1.

As shown in FIG. 1, the connector 2 has a left and right reinforced metal fitting 7 positioned to the outside of the plurality of terminals 4, 5 on the left and the right. The reinforced metal fittings 7 are formed from metal. For example, the reinforced metal fittings 7 are machined from metal plates. In this example, the reinforced metal fittings 7 are slender, plate-like components arranged in the front to rear direction (the direction indicated by Y1-Y2). The reinforced metal fitting 7 is arranged so that one surface faces outward in the left or right direction. As shown in FIG. 5, the reinforced metal fittings 7 have a slender inserted portion 75 on the rear end, which are forcibly inserted from the front into the left side portion and the right side portion of the housing 3. In this way, the reinforced metal fittings 7 are held by the housing 3. The reinforced metal fittings 7 have a fixed portion 71 on the lower edge of the foremost portion. When the connector 2 is used, the fixed portion 71 is soldered to a circuit board.

The housing 3 is molded from a resin such as a plastic so that it is easily deformed by the metal constituting the reinforced metal fittings 7. The housing 3 is molded into the shape of a box which is open in the front (in the direction indicated by Y1). A plurality of grooves is molded on the inside of the housing 3 and the terminals 4, 5 are forcibly inserted into these grooves.

As shown in FIG. 1, the housing 3 has inner wall portions 31 in the left side portion and the right side portion which are molded so as to extend forward. The inner wall portions 31 are molded so as to extend along the left and right edges of the flat cable 3 when the flat cable 9 is connected. The inner wall portions 31 have a lower wall portion 32 positioned below the engaged protrusion 91 formed on an edge of the flat cable 9 when the flat cable 9 is connected.

Figure 6:
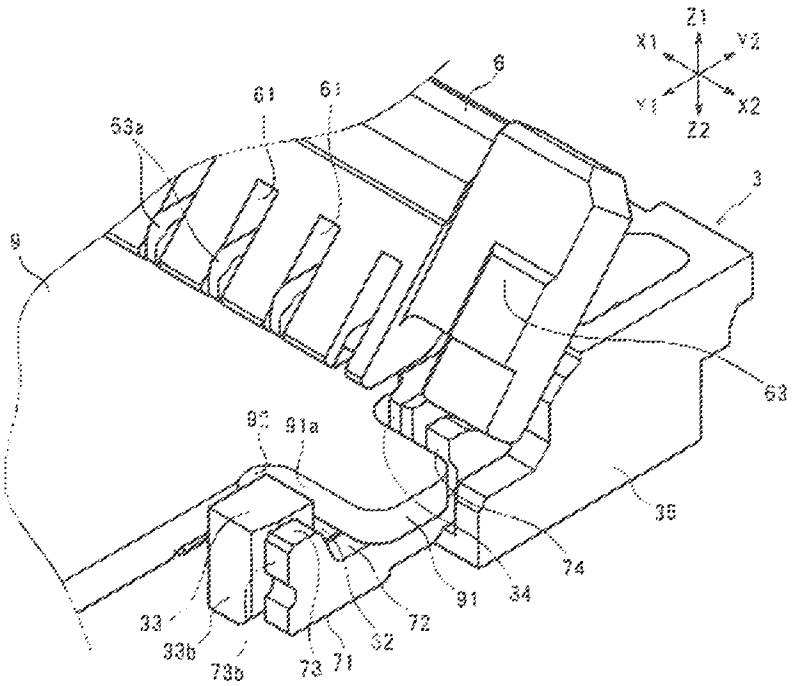
FIG. 6 is an enlarged perspective view of the connector and the flat cable of FIG. 1.

The housing 3 is able to keep the flat cable 9 from coming out when an inserted flat cable 9 is pulled out in the front (in the direction opposite that of the insertion direction). More specifically, as shown in FIG. 6, the inner wall portions 31 have an engagement protrusion 33 in the foremost portion. This engagement portion 33 is positioned in front of the lower wall portion 32 (see FIG. 1), and protrudes in front of the lower wall portion 32 (in the direction indicated by Z1). An engagement protrusion portion 33 is positioned to the left and right of the flat cable 9, and is molded so as to rise in front of the position where an engaged protrusion 91 is arranged. In other words, the engagement protrusions 33 are positioned relative to the engaged protrusions 91 in the direction opposite that of the insertion direction of the flat cable 9. When the flat cable 9 is pulled out in the front, the engaged protrusions 91 hit the engaging protrusions 33 and are kept from moving forward. This keeps the flat cable 9 from coming out. For example, the flat cable 9 is kept from coming out when the actuator 6 is arranged in the unlocked position.

Figure 7:
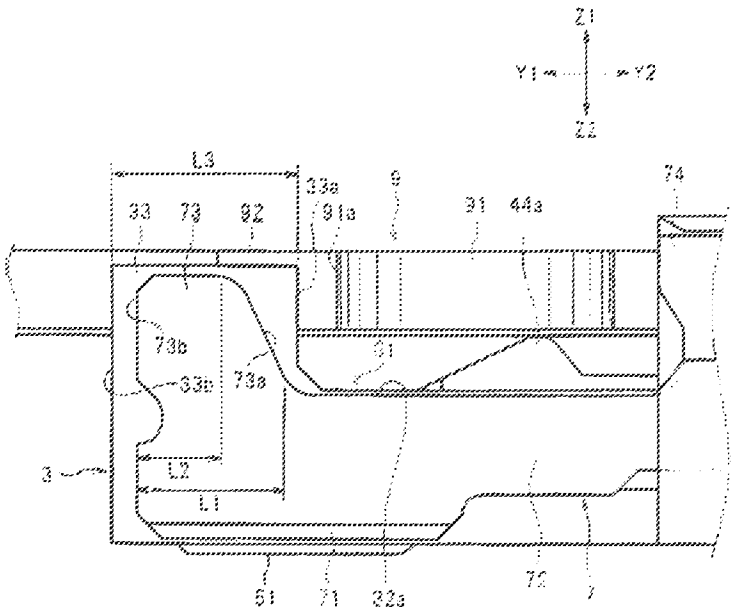
FIG. 7 is an enlarged side view of the connector and the flat cable of FIG. 1.

As shown in FIG. 7, the rear surface 33*a* of the engaging protrusion 33 faces directly to the rear (in the insertion direction of the flat cable 9 or in the direction indicated by Y2). In other words, a line perpendicular to the rear surface 33*a* is substantially parallel to the front to rear direction (the direction indicated by Y1-Y2). In this example, the upper surface 32*a* of the lower wall portion 32 is formed parallel to the horizontal plane, and the rear surface 33*a* is formed at a right angle to the upper surface 32*a*.

As shown in FIG. 6, a protruding portion 63 is formed in the left and right end portions of the actuator 6. When the actuator 6 is arranged in the locked position, the protruding portion 63 is positioned above the lower wall portion 32 described above and the lower wall portion 72 of the reinforced metal fitting 7 described below. When the flat cable 9 is inserted into the connector 2 and the actuator 6 is in the locked position, the protruding portions 63 push the engaged protrusion 91 towards the lower wall portions 32, 72. As a result, the flat cable 9 is effectively prevented from coming out.

The inner wall portion 31 has a rear wall portion 34 extending upward to the rear of the lower wall portion 32. A recessed portion is formed so that the engaged protrusion 91 is arranged inside by the rear wall portion 34, the lower wall portion 32, and the engaging protrusion 33.

Figure 8:
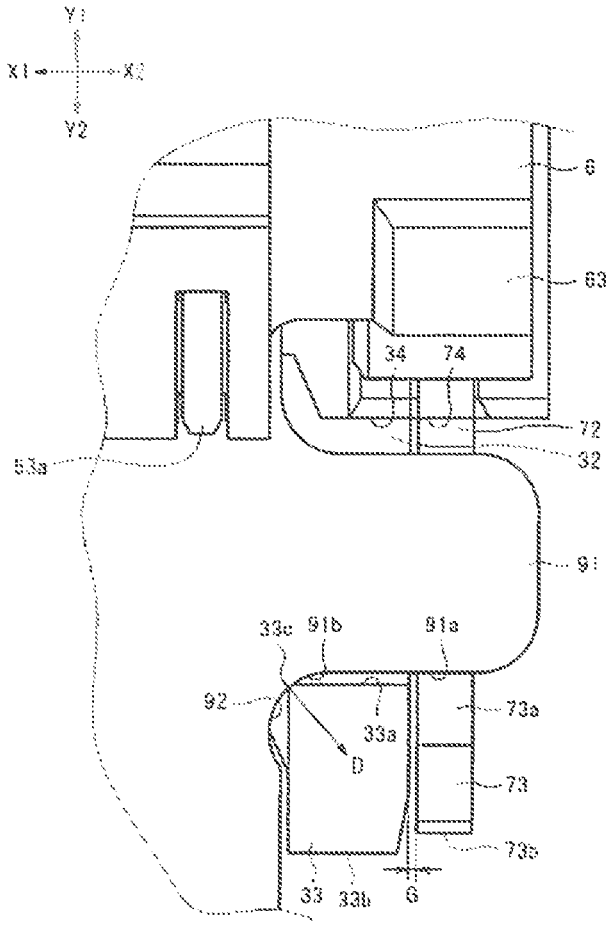
FIG. 8 is an enlarged top view of the connector and the flat cable of FIG. 1.

As shown in FIG. 8, the engaged protrusions 91 of the flat cable 9 have a front edge 91*a* which hits the engaging protrusions 33 when the flat cable 9 is pulled out. The front edge 91*a* is formed so as to hit the engaging protrusion 33 at an oblique angle. In this example, the end portion of the front edge 91*a* has a curved edge 91*b* which curves gently. When the flat cable 9 is pulled out, the curved edge 91*b* hits the engaging protrusion 33. The direction in which the curved edge 91*b* hits the engaging protrusion 33 (the direction indicated by D in FIG. 8) extends outward both in front and to the left or right. In other words, the direction orthogonal to the tangent of the curved edge 91*b* and the vertical direction (the direction indicated by Z1-Z2) extends outward in front and to the left or right. The engaging protrusion 33 is a rectangular column when viewed from above. When the flat cable 9 is pulled out, the curved edge 91*b* hits a corner 33*c* (the inner edge of the rear surface 33*a*) of the engaging protrusion 33, and the front edge 91*a* is separated from the rear surface 33*a*.

As shown in FIG. 8, a recessed portion 92 having an arc-shaped edge is formed on the left and right edges of the flat cable 9. This recessed portion 91 is positioned in front of the engaged protrusion 91. The front edge 91*a* (the curved edge 91*b* in this example) extends from the edge of the recessed portion 92. When the front edge 91*a* of the engaged protrusion 91 hits the engaging protrusion 33, the stress occurring in the engaged protrusion 91 is dispersed on the edge of the recessed portion 92, which keeps the engaged protrusion 91 from breaking. In other words, when the edge of the flat cable 9 is bent at the boundary between the front edge 91*a* and the left or right edge of the flat cable 9, the stress is concentrated in the bent portion. As shown in this example, recessed portions 92 with an arc-shaped edge are formed in the left and right edges to prevent the concentration of this stress.

As described above, when the flat cable 9 is pulled out in front, the curved edge 91*b* hits the engaging protrusion 33 at an oblique angle. As a result, force acts to push apart the engaging protrusion 33 in the left and right direction and/or force acts to rotate the engaging protrusion 33. In other words, the force sustained by the engaging protrusion 33 when the curved edge 91*b* hits the engaging protrusion 33 faces direction D in which the curved edge 91*b* hits the engaging protrusion 33. Thus, the force acts on the engaging protrusion 33 at an oblique angle. As a result, the engaging protrusion 33 is pushed apart outwardly in the left and right direction. Because the position at which the force acts (the corner 33*c* in this example) is away from the center of the engaging protrusion 33, the force turns the engaging protrusion 33 (the force turns the engaging protrusion 33 outward in the left or right direction).

As shown in FIG. 1, the reinforced metal fittings 7 are positioned outward to the left and right from the inner wall portion 31 of the housing 3, and are adjacent to the inner wall portion 31. In this example, a hole extending to the rear is formed between the outer wall portions 35 to the left and right of the housing 3 and the inner wall portion 31. The inserted portion 75 of a reinforced metal fitting 7 is inserted into this hole (see FIG. 5).

As shown in FIG. 6, the reinforced metal fitting 7 has a lower wall portion 72 positioned below the engaged protrusion 91 when the flat cable 9 is connected. The reinforced metal fitting 7 has a reinforced protrusion 73 on the foremost edge. The reinforced protrusion 73 protrudes forward in front of the lower wall portion 72, and rises along the engaging protrusion 33 in the housing 3. In this example, the engaged protrusion 91 rides over the lower wall portion 32 of the housing 3 and widens outward in the left and right directions. As a result, the reinforced protrusion 73 rises in front of the engaged protrusion 91 when the flat cable 9 is connected. In other words, the reinforced protrusion 73 is positioned in the direction opposite that of the insertion direction of the flat cable 9 with respect to the engaged protrusion 91.

As described above, when the engaged protrusion 91 hits the engaging protrusion 33, the force pushing apart the engaging protrusion 33 and force turning the engaging protrusion 33 are generated. The reinforced protrusion 73 is adjacent to the engaging protrusion 33, and restricts the movement of the engaging protrusion 33 caused by this force. As shown in FIG. 6 or FIG. 7, the reinforced metal fitting 7 has a rear wall portion 74 protruding upward to the rear of the lower wall portion 72. The rear wall portion 74, the lower wall portion 72, and the reinforced protrusion 73 form a recessed protrusion into which the engaged protrusion 91 is arranged.

As shown in FIG. 8, a slight gap G is disposed between the engaging protrusion 33 and the reinforced protrusion 73. As a result, slight movement of the engaging protrusion 33 caused by the force it is subjected to from the engaged protrusion 91 is allowed. In other words, the engaging protrusion 33 sustains force from the engaged protrusion 91, and is moved outward to the right or left and turned. When the reinforced protrusion 73 is hit, the reinforced protrusion 73 regulates the movement and rotation of the engaging protrusion 33.

As shown in FIG. 7, the rear surface 33*a* of the engaging protrusion 33 facing the insertion direction of the flat cable 9 (i.e., to the rear) is positioned to the rear of the rear surface 73*a* of the reinforced protrusion 73. In other words, the rear surface 33*a* of the engaging protrusion 33 is nearer the position at which the engaged protrusion 91 is arranged than the rear surface 73*a* of the reinforced protrusion 73. As a result, when the flat cable 9 is pulled forward, the engaged protrusion 91 hits the rear surface 33*a* of the engaging protrusion 33. The rear surface 73*a* of the reinforced protrusion 73 is not hit.

As shown in FIG. 7, the rear surface 73*a* of the reinforced protrusion 73 is formed so as to extend upward and forward from the lower wall portion 72. In other words, as the rear surface 73*a* moves upward, it moves away from the position at which the engaged protrusion 91 is arranged. In this example, the rear surface 73*a* is a flat surface inclining forward. This can ensure the strength of the reinforced protrusion 73 while reliably preventing the reinforced protrusion 73 from hitting the engaged protrusion 91. In other words, when the rear surface 73*a* is formed vertically, the entire rear surface 73*a* has to be positioned forward in order to keep the rear surface 73*a* from hitting the engaged protrusion 91. This reduces the width of the reinforced protrusion 73 in the front to back direction, which makes it difficult to ensure the strength of the reinforced protrusion 73. Because the rear surface 73*a* in this example is inclined, the width of the base portion of the reinforced protrusion 73 in the front to back direction is sufficient. As a result, the strength of the reinforced protrusion 73 can be maintained while reliably preventing the reinforced protrusion 73 from hitting the engaged protrusion 91. In most cases, the direction in which the flat cable 9 is pulled out is forward and upward. Therefore, when the flat cable 9 is pulled out, the position of the engaged protrusion 91 is moved forward and upward. In the connector 2, the movement of the rear surface 73*a* of the reinforced protrusion 73 upward increases the distance from the position at which the engaged protrusion 91 is arranged. As a result, the rear surface 73*a* is reliably prevented from hitting the engaged protrusion 91. In this example, as shown in FIG. 7, the distance L2 between the upper edge of the rear surface 73*a* of the reinforced protrusion 73 and the front surface 73 of the reinforced protrusion 73 is greater than half of the distance L1 between the lower edge of the rear surface 73*a* of the reinforced portion 73 and the front surface 73*b* of the reinforced protrusion 73.

As shown in FIG. 7, the front surface 73*b* of the reinforced protrusion 73 is positioned to the rear of the front surface 33*b* of the engaging protrusion 33. As a result, the width of the reinforced protrusion 73 in the front to rear direction (more specifically, L1) is smaller than the width L3 of the engaging protrusion 33 in the front to rear direction. Also, the length L1 between the lower edge of the rear surface 73*a* of the reinforced protrusion 73 and the front surface 73*b* of the reinforced protrusion 73 is greater than half the width L3 of the reinforced protrusion 33 in the housing 3 in the front to rear direction. Also, as shown in FIG. 8, the width of the engaging protrusion 33 in the left to right direction is greater than the width of the reinforced protrusion 73.

As described above, the lower beam 44 of the rear connection terminals 4 has a contact portion 44*a*. As shown in FIG. 1 and FIG. 7, the contact portion 44 is positioned to the right or the left of lower wall portion 32 of the housing 3 and the lower wall portion 72 of the reinforced metal fitting 7. In other words, the contact portion 44 is positioned in nearly the same position as the lower wall portions 32, 72 in the front to rear direction. Also, as shown in FIG. 7, the contact portion 44*a* is positioned higher than the upper surface 32*a* of the lower wall portion 32 and the upper surface 72*a* of the lower wall portion 72. Thus, when the actuator 6 is in the unlocked position, the front end of the flat cable 9 is supported by the contact portion 44*a* with the engaged portion 91 floating above the upper surfaces 32*a*, 72*a*. As a result, the engaged portion 91 easily rides up over the engaging protrusion 33 when the flat cable 9 is pulled out.

As explained above, the housing 3 of the connector 2 has an engaging protrusion 33 raised in front of the position at which the engaged protrusion 91 is arranged when a flat cable 9 is connected. Also, the reinforced metal fitting 7 has a reinforced protrusion 73 raised along the engaging protrusion 33 and positioned outward to the left and right relative to the engagement protrusion 33. The rear surface 33*a* of the engaging protrusion 33 is positioned to the rear of the rear surface 73*a* of the reinforced protrusion 73. Also, the rear surface 73*a* of the reinforced protrusion 73 is formed so as to extend upward and forward.

Because the rear surface 33 of the engaging protrusion 33 is positioned to the rear of the rear surface 73*a* of the reinforced protrusion 73 in this way, the flat cable 9 is kept from coming out by a housing 3 molded from resin. As a result, distortion of the engaged portions 91 on the flat cable 9 can be prevented. Also, because the reinforced protrusion 73 rises along the engaging protrusion 33, deformation of the engaging protrusion 33 is prevented. Because the rear surface 73*a* of the reinforced protrusion 73 is formed so as to extend upward and forward, the strength of the reinforced protrusion 73 is maintained, and the reinforced protrusion 73 is reliably kept from hitting the engaged protrusion 91.

The Present Disclosure is not restricted to the cable assembly 1 and connector 2 explained above. Other variations are possible. For example, the connector 2 had two types of terminals 4, 5. However, the connector 2 can also have a single type of terminal. Additionally, in the explanation, the engaged protrusion 91 goes over the lower wall portion 32 of the housing 3 and extends outward longitudinally. In the example described above, the end portion of the engaged protrusion 91 is arranged outside of the lower wall portion 72 of the reinforced metal fixture 7 longitudinally. However, the end portion of the engaged protrusion 91 can also be positioned above the lower wall portion 31.

While a preferred embodiment of the Present Disclosure is shown and described, it is envisioned that those skilled in the art may devise various modifications without departing from the spirit and scope of the foregoing Description and the appended Claims.

What is claimed is:

1. A connector in which a flat cable, on which an engaged protrusion has been formed extending outward longitudinally on at least one longitudinal edge, can be inserted from the front, the connector comprising:

a plurality of terminals, each terminal being lined up longitudinally;

a reinforced metal fitting, the metal fitting being positioned to the outside of the terminals to the left and right; and a housing, the housing being molded with a resin for holding the terminals and the metal fitting;

wherein:

the housing includes an engaging protrusion rising in front of the position in which the engaged protruding is arranged when the flat cable is connected;

the metal fitting includes a reinforced protrusion raised along the engaging protrusion and positioned to the outside of the engaging protrusion longitudinally;

a rear surface of the engaging protrusion is positioned to the rear of a rear surface of the reinforced protrusion; and the rear surface of the reinforced protrusion is formed so as to extend upward and forward, and to come into contact with the flat cable.

2. The connector of claim 1, wherein a gap is formed between the reinforced protrusion and the engaging protrusion.

3. The connector of claim 1, wherein the housing has a lower wall portion positioned below the engaged protrusion when the flat cable is connected.

4. The connector of claim 3, wherein the contacts of each terminal, establishing contact with the flat cable, are positioned to the left or to the right of the lower wall portion, and above the upper surface of the lower wall portion of the housing.

5. A cable assembly comprising a flat cable, on which an engaged protrusion is formed extending outward longitudinally on at least one longitudinal edge, and a connector to which the flat cable is connected, the connector comprising:

a plurality of terminals, each terminal being lined up longitudinally;

a reinforced metal fitting, the metal fitting being positioned to the outside of the terminals to the left and right; and a housing, the housing being molded with a resin for holding the terminals and the metal fitting;

wherein:

the housing includes an engaging protrusion rising in front of the position in which the engaged protruding is arranged when the flat cable is connected;

the metal fitting includes a reinforced protrusion raised along the engaging protrusion and positioned to the outside of the engaging protrusion longitudinally;

a rear surface of the engaging protrusion is positioned to the rear of a rear surface of the reinforced protrusion; and the rear surface of the reinforced protrusion is formed so as to extend upward and forward , and to come into contact with the flat cable.

6. The cable assembly of claim 5, wherein a front edge, hitting the engaging protrusion when the flat cable is moved forward, is formed on the edge of the engaged protrusion of the flat cable.

7. The cable assembly of claim 6, wherein the direction in which the front edge hits the engaging protrusion extends outward longitudinally.

8. The cable assembly of claim 7, wherein a recessed portion having an arc-shaped edge is formed on at least one edge of the flat cable, positioned in front of the engaged protrusion.

9. The cable assembly of claim 8, wherein a front edge of the engaged protrusion formed in the flat cable extends from the edge of the recessed portion.

10. The cable assembly of claim 7, wherein a gap is formed between the reinforced protrusion and the engaging protrusion.

* * * * *